US007192678B2

(12) United States Patent
Tong et al.

(10) Patent No.: US 7,192,678 B2
(45) Date of Patent: Mar. 20, 2007

(54) PHOTORECEPTOR CHARGE TRANSPORT LAYER COMPOSITION

(75) Inventors: Yuhua Tong, Webster, NY (US); Kenny-Tuan T. Dinh, Webster, NY (US); Markus R. Silvestri, Fairport, NY (US); Michael E. Zak, Canandaigue, NY (US); John F. Yanus, Webster, NY (US); Min-Hong Fu, Webster, NY (US); David M. Skinner, Rochester, NY (US); Kathleen M. Carmichael, Williamson, NY (US); Colleen A. Helbig, Penfield, NY (US); Dale S. Renfer, Webster, NY (US); John A. Bergfjord, Sr., Macedon, NY (US); Susan M. Van Dusen, Williamson, NY (US)

(73) Assignee: Xerox Corporation, Stamford, CT (US)

( * ) Notice: Subject to any disclaimer, the term of this patent is extended or adjusted under 35 U.S.C. 154(b) by 395 days.

(21) Appl. No.: 10/889,054

(22) Filed: Jul. 13, 2004

(65) Prior Publication Data

US 2006/0014089 A1 Jan. 19, 2006

(51) Int. Cl.
*G03G 5/06* (2006.01)

(52) U.S. Cl. ..... 430/74; 430/58.65; 430/58.8; 430/970; 430/59.6; 399/159

(58) Field of Classification Search ..... 430/58.05, 430/59.6, 58.8, 58.65, 74; 399/159
See application file for complete search history.

(56) References Cited

U.S. PATENT DOCUMENTS

| | | | | |
|---|---|---|---|---|
| 4,047,948 | A | 9/1977 | Horgan | |
| 4,265,990 | A | 5/1981 | Stolka et al. | |
| 4,346,158 | A | 8/1982 | Pai et al. | |
| 4,388,392 | A | 6/1983 | Kato et al. | |
| 4,801,517 | A | 1/1989 | Frechet et al. | |
| 4,806,443 | A | 2/1989 | Yanus et al. | |
| 4,818,650 | A | 4/1989 | Limburg et al. | |
| 4,959,288 | A | 9/1990 | Ong et al. | |
| 5,122,429 | A | 6/1992 | Sundararajan et al. | |
| 5,202,408 | A | 4/1993 | Yanus et al. | |
| 5,262,512 | A | 11/1993 | Yanus et al. | |
| 5,681,678 | A | 10/1997 | Nealey et al. | |
| 6,194,111 | B1 | 2/2001 | Fuller et al. | |
| 6,645,686 | B1 | 11/2003 | Fu et al. | |
| 2005/0164104 | A1 * | 7/2005 | Tong et al. | 430/58.8 |

FOREIGN PATENT DOCUMENTS

| | | | |
|---|---|---|---|
| EP | 0 034 425 A2 | | 8/1981 |
| JP | 07271060 A | * | 10/1995 |
| JP | 11038647 A | * | 2/1999 |

OTHER PUBLICATIONS

Diamond, Arthur S & David Weiss (eds.) Handbook of Imaging Materials. New York: Marcel-Dekker, Inc. (Nov. 2001) pp. 145-164.*

* cited by examiner

*Primary Examiner*—Christopher Rodee
(74) *Attorney, Agent, or Firm*—Oliff & Berridge, PLC

(57) ABSTRACT

A charge transport layer composition for a photoreceptor includes at least a binder and a charge transport material of about 100% to about 40% by weight of a total of the charge transport layer N,N-dimethylphenyl)-4-biphenylamine and about 0% to about 60% N,N'-dephenyl-N,N'-bis(3-methylphenyl)-(1,1'-biphenyl)-4,4'-diamine, and wherein the total charge transport material in the composition is 48% or less of the total solids of the composition. The charge transport layer forms a layer of a photoreceptor, which also includes an optional anti-curl layer, a substrate, an optional hole blocking layer, an optional adhesive layer, a charge generating layer, and optionally one or more overcoat or protective layers.

17 Claims, 1 Drawing Sheet

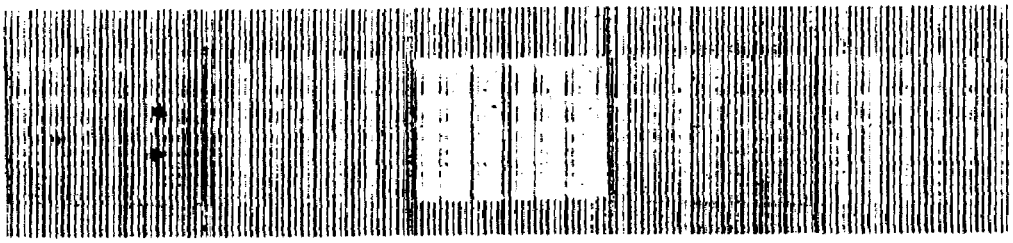
Ex: 3 4 Comparative 2 5 6

PHOTORECEPTOR CHARGE TRANSPORT LAYER COMPOSITION

BACKGROUND OF THE INVENTION

1. Field of Invention

This invention relates to a novel composition for a charge transport layer of a photoreceptor used in electrophotographic devices such as photocopiers. More in particular, the invention relates to a particular composition for a charge transport layer that includes binder and one or more charge transporting molecules in specified amounts, along with optional anti-oxidants and acid dopants.

2. Description of Related Art

In the art of electrophotography, an electrophotographic imaging member or plate comprising a photoconductive insulating layer on a conductive layer is imaged by first uniformly electrostatically charging the surface of the photoconductive insulating layer. The plate is then exposed to a pattern of activating electromagnetic radiation, for example light, which selectively dissipates the charge in the illuminated areas of the photoconductive insulating layer while leaving behind an electrostatic latent image in the non-illuminated areas. This electrostatic latent image may then be developed to form a visible image by depositing finely divided electroscopic toner particles, for example from a developer composition, on the surface of the photoconductive insulating layer. The resulting visible toner image can be transferred to a suitable receiving member such as paper. This imaging process may be repeated many times with reusable photosensitive members.

Electrophotographic imaging members are usually multilayered photoreceptors that comprise a substrate support, an electrically conductive layer, an optional hole blocking layer, an optional adhesive layer, a charge generating layer, a charge transport layer, and optional protective or overcoating layer(s). The imaging members can take several forms, including flexible belts, rigid drums, etc. For most multilayered flexible photoreceptor belts, an anti-curl layer is usually employed on the back side of the substrate support, opposite to the side carrying the electrically active layers, to achieve the desired photoreceptor flatness.

Typical electrophotographic imaging members (for example, photoreceptors) comprise a photoconductive layer comprising a single layer or composite layers. One type of composite photoconductive layer used in xerography is illustrated, for example, in U.S. Pat. No. 4,265,990, which describes a photosensitive member having at least two electrically operative layers. One layer comprises a photoconductive layer which is capable of photogenerating holes and injecting the photogenerated holes into a contiguous charge transport layer. Generally, where the two electrically operative layers are supported on a conductive layer, the photogenerating layer is sandwiched between the contiguous charge transport layer and the supporting conductive layer, and the outer surface of the charge transport layer is normally charged with a uniform electrostatic charge.

As more advanced, complex, highly sophisticated, electrophotographic copiers, duplicators and printers are developed, greater demands are placed on the photoreceptor to meet stringent requirements for the production of high quality images.

One type of multi-layered photoreceptor that has been employed as a belt in electrophotographic imaging systems comprises a substrate, a conductive layer, a charge blocking layer, a charge generating layer, and a charge transport layer. The charge transport layer often comprises an activating small molecule dispersed or dissolved in a polymeric film forming binder. Generally, the polymeric film forming binder in the transport layer is electrically inactive by itself and becomes electrically active when it contains the activating molecule. The expression "electrically active" means that the material is capable of supporting the injection of photogenerated charge carriers from the material in the charge generating layer and is capable of allowing the transport of these charge carriers through the electrically active layer in order to discharge a surface charge on the active layer. The multi-layered type of photoreceptor may also comprise additional layers such as an anti-curl backing layer, required when layers possess different coefficient of thermal expansion values, an adhesive layer, and an overcoating layer. Commercial high quality photoreceptors have been produced which utilize an anti-curl coating.

Photoreceptors have been developed which comprise charge transfer complexes prepared with polymeric molecules. For example, charge transport complexes formed with polyvinyl carbazole are disclosed in U.S. Pat. Nos. 4,047,948, 4,346,158 and 4,388,392. Photoreceptors utilizing polyvinyl carbazole layers, as compared with current photoreceptor requirements, exhibit relatively poor xerographic performance in both electrical and mechanical properties. Polymeric arylamine molecules prepared from the condensation of di-secondary amine with a di-iodo aryl compound are disclosed in European Patent Publication No. 34,425, published Aug. 26, 1981. Since these polymers are extremely brittle and form films which are very susceptible to physical damage, their use in a flexible belt configuration is precluded.

Photoreceptors having charge transport layers containing charge transporting arylamine polymers have been described in the patent literature, for example in U.S. Pat. Nos. 4,806,443, 4,806,443, 4,801,517, 4,818,650, 4,959,288, 5,202,408 and 5,262,512, the entire disclosures of these patents being incorporated herein by reference. These polymers tend to possess poor mechanical properties and are soft and non-robust.

Other photoreceptors having charge transport layers containing a charge transport molecule and a binder mixture comprising a polycarbonate and an elastomeric block copolymer have been described in U.S. Pat. No. 5,122,429.

U.S. Pat. No. 6,645,686 describes an electrophotographic imaging member having a charge transport layer that is comprised of a binder and charge transport molecules, wherein the binder eliminates or minimizes crystallization of the charge transport molecules. Specific binders are polycarbonate binders such as PCZ-800, PCZ-500, and PCZ-400 polycarbonate resin.

U.S. Pat. No. 6,194,111 describes a crosslinkable charge transport layer material for a photoconductor that includes at least one poly(arylene ether alcohol), at least one polyisocyanate crosslinking agent and at least one charge transport material dispersed in a solvent. The crosslinkable charge transport layer material is crosslinked following application of the coating solution to the photoconductor. The photoconductor including such crosslinked charge transport layer exhibits excellent wear resistance so as to have long life, thereby reducing the cost of electrophotographic printing machines employing such photoconductors therein.

One of the most noticeable problems still present in current organic photoreceptors is lateral charge migration (LCM). It appears that a primary cause of LCM is an externally induced conductivity of the photoreceptor surface, which results in charge spreading of the latent electrostatic image, which image in turn is subsequently developed less precisely by toner.

There continues to be a need for improved electrophotographic imaging members, particularly imaging members that are able to achieve high quality images and exhibit no lateral charge migration on a xerographic time scale.

SUMMARY OF THE INVENTION

In a first embodiment, the present invention relates to a charge transport layer composition for a photoreceptor, comprising at least a binder and a charge transport material, wherein the charge transport material is comprised of N,N-di-(3,4-dimethylphenyl)-4-biphenylamine (DBA) and 0 to about 60% by weight of a total of the charge transport material of N,N'-diphenyl-N,N'-bis(3-methylphenyl)-(1,1'-biphenyl)-4,4'-diamine (TPD), and wherein the total of the charge transport material in the composition comprises 48% or less of the total solids of the composition.

In a further embodiment, the present invention relates to an image forming device comprising at least a photoreceptor and a charging device which charges the photoreceptor, wherein the photoreceptor comprises an optional anti-curl layer, a substrate, an optional hole blocking layer, an optional adhesive layer, a charge generating layer, a charge transport layer comprising at least a binder and a charge transport material, wherein the charge transport material is comprised of about 40 to about 100% by weight of a total of the charge transport material comprises N,N-di-(3,4-dimethylphenyl)-4-biphenylamine (DBA) and with about 60 to about 0% of N,N'-diphenyl-N,N'-bis(3-methylphenyl)-(1,1'-biphenyl)-4,4'-diamine (TPD), and wherein the total of the charge transport material in the composition comprises 48% or less of the total solids of the composition, and optionally one or more overcoat or protective layers.

In a still further embodiment, the present invention relates to an electrophotographic device that contains the image forming device of the invention.

The charge transport layer of the present invention exhibits no detectable lateral charge migration, exhibits good resistance to cracking induced by solvent vapors and corona effluents, and exhibits good cyclic stability (substantially no cycle-up problems). The charge transport layer of the invention thus enables production of photoreceptors capable of achieving high quality reprographic images over its period of use.

BRIEF DESCRIPTION OF DRAWING

The FIGURE shows printing lines of example and comparative example formulations after exposure to corona effluents.

DETAILED DESCRIPTION OF PREFERRED EMBODIMENTS

The charge transport layer composition of the invention must include at least a binder and a charge transport material comprised of (a) about 40 to about 100% by weight of a total of the charge transport material N,N-di-(3,4-dimethylphenyl)-4-biphenylamine (DBA) and (b) about 60 to about 0% of N,N'-diphenyl-N,N'-bis(3-methylphenyl)-(1,1'-biphenyl)-4,4'-diamine (TPD), wherein the total of the charge transport material in the composition comprises 48% or less of the total solids of the composition. Each of these required components of the composition is discussed below.

The binder should eliminate or minimize crystallization of the charge transport agent and should be soluble in a solvent selected for use with the composition such as, for example, methylene chloride, chlorobenzene, tetrahydrofuran, toluene or another suitable solvent. Suitable binders may include, for example, polycarbonates, polyesters, polyarylates, polyacrylates, polyethers, polysulfones and mixtures thereof. For the preferred solvent of methylene chloride and the preferred charge transport agents, the binder is preferably a polycarbonate. Although any polycarbonate binder may be used, preferably the polycarbonate is either a bisphenol Z polycarbonate or a biphenyl A polycarbonate. Example biphenyl A polycarbonates are the MAKROLON® polycarbonates. Example bisphenol Z polycarbonates are the LUPILON® polycarbonates, also widely identified in the art as PCZ polycarbonates, e.g., PCZ-800, PCZ-500 and PCZ-400 polycarbonate resins and mixtures thereof.

As the charge transport material, prior art formulations have typically utilized N,N'-diphenyl-N,N'-bis(3-methylphenyl)-(1,1'-biphenyl)-4,4'-diamine (TPD) as the only charge transport material of the charge transport layer. However, TPD is not without problems. In particular, TPD is believed to form mobile positive charge carriers (i.e., holes) that enable conductivity when oxidized by nitrous oxide effluents from bias charging rolls and corona charging devices. In electrophotographic devices utilizing multiple corotron charging devices around the photoreceptor, this problem can be magnified. The oxidation of the charge transport agents is believed to result in increased conductivity at the surface of the photoreceptor, thereby causing lateral charge migration (LCM) and ultimately poor image reproduction.

PCZ polycarbonate binder was found to assist in the reduction of lateral charge migration. Because PCZ polycarbonates are more resistant to LCM effects, they are most preferred in the present invention. However, the use of a binder resistant to LCM effects alone may not sufficiently eliminate the formation of mobile charge carriers through oxidation of the charge transport agent TPD.

In the present invention, it has been found that the charge transport material N,N-di-(3,4-dimethylphenyl)-4-biphenylamine (DBA) may be advantageously used in place of or in conjunction with TPD. In particular, DBA has been found not to form long-lived conductive species with nitrous oxides, and thus its use substantially eliminates the lateral charge migration problem associated with other known charge transport agents such as TPD. For example, with nitrous oxides, triarylamines generally react without forming persistent intermediate species to rapidly form nitro triphenylamines. The amounts of DBA are preferably of sufficient concentration at the photoreceptor surface to substantially reduce the availability of TPD moieties that can form deleterious conductive species.

N,N-di-(3,4-dimethylphenyl)-4-biphenylamine [biphenyl-4-yl-bis-(3,4-dimethyl-phenyl)-amine] (DBA) has the following structure:

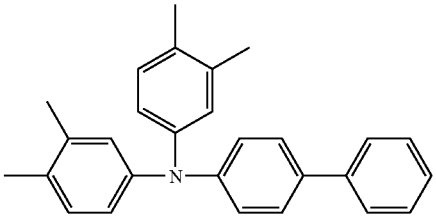

While in certain applications it may be appropriate to use DBA alone as the charge transport material of the charge transport layer, it is more preferable to add additional charge transport materials to the composition. For example, DBA is known to exhibit slower hole mobility on a molar basis in the charge transport layer at lower fields, which may not be suitable in some applications. It is thus possible to retain an amount of other higher mobility charge transport agents for use in the composition in conjunction with DBA. For example, addition of 0 to about 60% by weight or less, more preferably addition of between about 10% and about 50% by weight, based on a total weight of all charge transport materials present in the composition, of a higher mobility charge transport agent, preferably TPD, may be suitable. DBA is thus most preferably present in the composition in an amount of between about 50% to about 90% by weight of the charge transport materials in the composition.

Addition of an amount of TPD within the aforementioned ranges with DBA is sufficient to appropriately offset the lower hole mobility of DBA without adversely affecting the lateral charge migration. In addition, the mixture of DBA and TPD is more resistant to solvent vapor and corona effluents than TPD alone.

The total amount of charge transport agents in the charge transport layer composition is preferably kept to 48% or less of the total solids of the composition. More preferably, the amount of charge transport agents is from about 30% to about 46% by weight of total solids, even more preferably about 40% to about 44% by weight of total solids, most preferably about 43% of total solids.

It has surprisingly been found that if the amounts of the charge transport agents in the charge transport layer composition are maintained within the above limits, the amount of cracking that may develop in the photoreceptor is reduced, resulting in increased mechanical life of the photoreceptor. Photoreceptor life can be shortened if cracks develop. If the cracks are of considerable depth, for example going from the top layer through to the substrate, they can become printable so as to degrade print quality. Cracks are possibly caused by solvent vapors from cleaning processes using organic solvents, breakdown of mechanical strength of the belt, or long exposure to corona effluents. Cracks developing in charge transport layers during cycling can be manifested as print-out defects adversely affecting copy quality. Furthermore, cracks in the photoreceptor pick up toner particles which cannot be removed in the cleaning step and may be transferred to the background in subsequent prints. In addition, crack areas are subject to delamination when contacted with blade cleaning devices, thus limiting the options in electrophotographic product design. It should also be noted that the presence of an anti-curl back coating will exacerbate the propagation of cracks in brittle polymers. Controlling the amount of the charge transport agents as above can reduce and/or eliminate cracking such that the mechanical life of the photoreceptor can be lengthened.

DBA, with or without TPD, may also still suffer from poor cyclic stability. That is, DBA may tend to exhibit higher residual voltages (Vr), which also have a serious cycle-up problem with repeated electrical cycling. To address this potential problem, it is optional to also include in the charge transport composition a vinyl chloride copolymer composed of at least vinyl chloride, vinyl acetate, hydroxy alkyl acrylate and maleic acid. The vinyl chloride copolymer acts as a mild acid doping agent that associates with the TPD, substantially eliminating cycle-up when DBA, with or without TPD, is used as a co-charge transport material.

Preferably, the vinyl chloride copolymer is included in the composition in an amount of about 5% by weight, solids basis, or less. More preferably, the vinyl chloride copolymer is included in the composition in an amount of less than about 1% by weight, most preferably from about 0.2 to about 0.9% by weight.

In the vinyl chloride copolymer composed of at least vinyl chloride, vinyl acetate, hydroxy alkyl acrylate and maleic acid, the hydroxy alkyl acrylate is preferably hydroxy ethyl acrylate, hydroxy propyl acrylate, or a mixture thereof. A suitable commercially available vinyl chloride copolymer is UCARMAG 527®, comprising a polymeric reaction product of about 81 weight percent vinyl chloride, about 4 weight percent vinyl acetate, about 15 weight percent hydroxyethyl acrylate, and about 0.28 weight percent maleic acid and having a weight average molecular weight of about 35,000. See also U.S. Pat. No. 5,681,678, incorporated herein by reference.

UCARMAG 527® is believed to have the following structure:

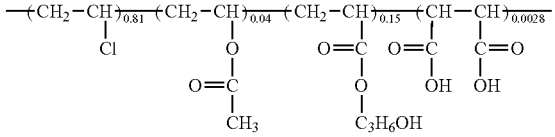

The charge transport layer composition may optionally also include an antioxidant that further assists in prevention of lateral charge migration. While antioxidants such as IRGANOX™ have been known to be added to charge transport layers for prevention of LCM, the optional antioxidant in the present composition is a hindered phenol antioxidant. Of course, it should be emphasized that as the hindered phenol antioxidant has a tendency to raise the background voltage and to shorten the photoreceptor life, and as the charge transport material DBA already provides the device sufficient LCM resistance, the presence of the hindered phenol antioxidant may not be necessary.

When included, the hindered phenol antioxidant preferably has a formula:

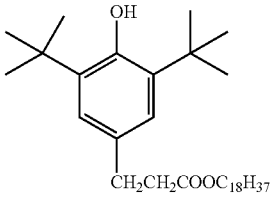

A suitable hindered phenol antioxidant having the foregoing formula is commercially available as CYANOX™ 2176. If added, the hindered phenol antioxidant is present in an amount of less than about 5% by weight of the composition, preferably about 2.5% by weight or less, e.g., from about 0.1 to about 2.5% by weight.

The charge transport layer composition is preferably made to include a solvent. In the present invention, the solvent used is preferably methylene chloride, although other solvents may be used without restriction, such as tetrahydrofuran (THF), toluene and the like if polymer solubility is maintained.

The charge transport layer composition may also include additional additives used for their known conventional functions as recognized by practitioners in the art. Such additives may include, for example, leveling agents, surfactants, wear resistant additives such as polytetrafluoroethylene (PTFE) particles, light shock resisting or reducing agents, and the like.

The total solids to total solvents of the coating material may preferably be around about 10:90% by weight to about 30:70% by weight, more preferably between about 5:85% by weight to about 25:75% by weight.

To form the charge transport layer material of the present invention, the components of the composition of the material are added to a vessel, for example a vessel equipped with a stirrer. The components may be added to the vessel in any order without restriction. Once all of the components of the charge transport layer material have been added to the vessel, the solution may be mixed to form a uniform coating composition.

The charge transport layer solution is applied to the photoreceptor structure (which is detailed below). More in particular, the layer is formed upon a previously formed layer of the photoreceptor structure. Most preferably, the charge transport layer may be formed upon a charge generating layer. Any suitable and conventional technique may be utilized to apply the charge transport layer coating solution to the photoreceptor structure. Typical application techniques include, for example, spraying, dip coating, extrusion coating, roll coating, wire wound rod coating, draw bar coating and the like.

The other layers of the photoreceptor will next be explained. It should be emphasized that it is contemplated that the invention covers any photoreceptor structure, regardless of additional layers present and regardless of the ordering of the layers within the structure, so long as the charge transport layer includes the copolymer polycarbonate of the invention as described above. The photoreceptor may have any form, for example drum, belt, etc., without restriction.

Any suitable multilayer photoreceptor may be employed in the imaging member of this invention. The charge generating layer and charge transport layer as well as the other layers may be applied in any suitable order to produce either positive or negative charging photoreceptors. For example, the charge generating layer may be applied prior to the charge transport layer, as illustrated in U.S. Pat. No. 4,265,990, or the charge transport layer may be applied prior to the charge generating layer, as illustrated in U.S. Pat. No. 4,346,158, the entire disclosures of these patents being incorporated herein by reference. Most preferably, however, the charge transport layer is employed upon a charge generating layer, and the charge transport layer may optionally be overcoated with an overcoat and/or protective layer.

A photoreceptor of the invention employing the charge transport layer may comprise an optional anti-curl layer, a substrate, an optional hole blocking layer, an optional adhesive layer, a charge generating layer, the charge transport layer, and one or more optional overcoat and/or protective layer(s).

The photoreceptor substrate may comprise any suitable organic or inorganic material known in the art. The substrate can be formulated entirely of an electrically conductive material, or it can be an insulating material having an electrically conductive surface. The substrate is of an effective thickness, generally up to about 100 mils, and preferably from about 1 to about 50 mils, although the thickness can be outside of this range. The thickness of the substrate layer depends on many factors, including economic and mechanical considerations. Thus, this layer may be of substantial thickness, for example over 100 mils, or of minimal thickness provided that there are no adverse effects on the system. Similarly, the substrate can be either rigid or flexible. In a particularly preferred embodiment, the thickness of this layer is from about 3 mils to about 10 mils. For flexible belt imaging members, preferred substrate thicknesses are from about 65 to about 150 microns, and more preferably from about 75 to about 100 microns for optimum flexibility and minimum stretch when cycled around small diameter rollers of, for example, 19 millimeter diameter.

The substrate can be opaque or substantially transparent and can comprise numerous suitable materials having the desired mechanical properties. The entire substrate can comprise the same material as that in the electrically conductive surface or the electrically conductive surface can be merely a coating on the substrate. Any suitable electrically conductive material can be employed. Typical electrically conductive materials include copper, brass, nickel, zinc, chromium, stainless steel, conductive plastics and rubbers, aluminum, semitransparent aluminum, steel, cadmium, silver, gold, zirconium, niobium, tantalum, vanadium, hafnium, titanium, nickel, chromium, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. The conductive layer can vary in thickness over substantially wide ranges depending on the desired use of the electrophotoconductive member. Generally, the conductive layer ranges in thickness from about 50 Angstroms to many centimeters, although the thickness can be outside of this range. When a flexible electrophotographic imaging member is desired, the thickness of the conductive layer typically is from about 20 Angstroms to about 750 Angstroms, and preferably from about 100 to about 200 Angstroms for an optimum combination of electrical conductivity, flexibility, and light transmission. When the selected substrate comprises a nonconductive base and an electrically conductive layer coated thereon, the substrate can be of any other conventional material, including organic and inorganic materials. Typical substrate materials include insulating non-conducting materials such as various resins known for this purpose including polycarbonates, polyamides, polyurethanes, paper, glass, plastic, polyesters such as MYLAR™ (E. I. duPont de Nemours & Co.), MELINEX™ (duPont-Teijin Film), KALEDEX™ 2000 (ICI Americas Inc.), TEONEX™ (ICI Americas Inc.), or HOSTAPHAN™ (American Hoechst Corporation) and the like. The conductive layer can be coated onto the base layer by any suitable coating technique, such as vacuum deposition or the like. If desired, the substrate can comprise a metallized plastic, such as titanized or aluminized MYLAR, wherein the metallized surface is in contact with the photogenerating layer or any other layer situated between the substrate and the photogenerating layer. The coated or uncoated substrate can be flexible or rigid, and can have any number of configurations, such as a plate, a cylindrical drum, a scroll, an endless flexible belt, or the like. The outer surface of the substrate may comprise a metal oxide such as aluminum oxide, nickel oxide, titanium oxide, or the like. If a drum, the drum is most preferably in the form of a small diameter drum of the type used in copiers and printers.

A hole blocking layer may then optionally be applied to the substrate. Generally, electron blocking layers for positively charged photoreceptors allow the photogenerated holes in the charge generating layer at the top of the photoreceptor to migrate toward the charge (hole) transport layer below and reach the bottom conductive layer during the electrophotographic imaging processes. Thus, an electron blocking layer is normally not expected to block holes in positively charged photoreceptors such as photoreceptors coated with a charge generating layer over a charge (hole) transport layer. For negatively charged photoreceptors, any suitable hole blocking layer capable of forming an electronic barrier to holes between the adjacent photoconductive layer and the underlying zirconium or titanium layer may be utilized. A hole blocking layer may comprise any suitable material. Typical hole blocking layers utilized for the negatively charged photoreceptors may include, for example, polyamides such as LUCKAMIDE (a nylon-6 type material derived from methoxymethyl-substituted polyamide), hydroxy alkyl methacrylates, nylons, gelatin, hydroxyl alkyl cellulose, organopolyphosphazenes, organosilanes, organotitanates, organozirconates, silicon oxides, zirconium oxides, and the like. Preferably, the hole blocking layer comprises nitrogen containing siloxanes. Typical nitrogen containing siloxanes are prepared from coating solutions containing a hydrolyzed silane. Typical hydrolyzable silanes include 3-aminopropyl triethoxy silane, (N,N'-dimethyl 3-amino) propyl triethoxysilane, N,N-dimethylamino phenyl triethoxy silane, N-phenyl aminopropyl trimethoxy silane, trimethoxy silylpropyldiethylene triamine and mixtures thereof.

During hydrolysis of the amino silanes described above, the alkoxy groups are replaced with hydroxyl group. An especially preferred blocking layer comprises a reaction product between a hydrolyzed silane and the zirconium and/or titanium oxide layer which inherently forms on the surface of the metal layer when exposed to air after deposition. This combination reduces spots and provides electrical stability at low RH. The imaging member is prepared by depositing on the zirconium and/or titanium oxide layer of a coating of an aqueous solution of the hydrolyzed silane at a pH between about 4 and about 10, drying the reaction product layer to form a siloxane film and applying electrically operative layers, such as a photogenerator layer and a hole transport layer, to the siloxane film.

The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layers are preferably applied in the form of a dilute solution, with the solvent being removed after deposition of the coating by conventional techniques such as by vacuum, heating and the like. This siloxane coating is described in U.S. Pat. No. 4,464,450, the disclosure thereof being incorporated herein in its entirety. After drying, the siloxane reaction product film formed from the hydrolyzed silane contains larger molecules. The reaction product of the hydrolyzed silane may be linear, partially crosslinked, a dimer, a trimer, and the like.

The siloxane blocking layer should be continuous and have a thickness of less than about 0.5 micrometer because greater thicknesses may lead to undesirably high residual voltage. A blocking layer of between about 0.005 micrometer and about 0.3 micrometer (50 Angstroms to 3,000 Angstroms) is preferred because charge neutralization after the exposure step is facilitated and optimum electrical performance is achieved.

An adhesive layer may optionally be applied to the hole blocking layer. The adhesive layer may comprise any suitable film forming polymer. Typical adhesive layer materials include, for example, copolyester resins, polyarylates, polyurethanes, blends of resins, and like.

A preferred copolyester resin is a linear saturated copolyester reaction product of four diacids and ethylene glycol. The molecular structure of this linear saturated copolyester in which the mole ratio of diacid to ethylene glycol in the copolyester is 1:1. The diacids are terephthalic acid, isophthalic acid, adipic acid and azelaic acid. The mole ratio of terephthalic acid to isophthalic acid to adipic acid to azelaic acid is 4:4:1:1. A representative linear saturated copolyester adhesion promoter of this structure is commercially available as 49,000 (available from Rohm and Haas Inc., previously available from Morton International Inc.). Another preferred representative polyester resin is a copolyester resin derived from a diacid selected from the group consisting of terephthalic acid, isophthalic acid, and mixtures thereof and diol selected from the group consisting of ethylene glycol, 2,2-dimethyl propanediol and mixtures thereof; the ratio of diacid to diol being 1:1. Typical polyester resins are commercially available and include, for example, VITEL polyesters.

The diacids from which the polyester resins of this invention are derived are terephthalic acid, isophthalic acid, adipic acid and/or azelaic acid acids only. Any suitable diol may be used to synthesize the polyester resins employed in the adhesive layer of this invention. Typical diols include, for example, ethylene glycol, 2,2-dimethyl propane diol, butane diol, pentane diol, hexane diol, and the like.

Alternatively, the adhesive interface layer may comprise polyarylate (ARDEL D-100, available from Amoco Performance Products, Inc.), polyurethane or a polymer blend of these polymers with a carbazole polymer. Adhesive layers are well known and described, for example in U.S. Pat. Nos. 5,571,649, 5,591,554, 5,576,130, 5,571,648, 5,571,647 and 5,643,702, the entire disclosures of these patents being incorporated herein by reference.

Any suitable solvent may be used to form an adhesive layer coating solution. Typical solvents include tetrahydrofuran, toluene, hexane, cyclohexane, cyclohexanone, methylene chloride, 1,1,2-trichloroethane, monochlorobenzene, and the like, and mixtures thereof. Any suitable technique may be utilized to apply the adhesive layer coating. Typical coating techniques include extrusion coating, gravure coating, spray coating, wire wound bar coating, and the like. The adhesive layer is applied directly to the charge blocking layer. Thus, the adhesive layer of this invention is in direct contiguous contact with both the underlying charge blocking layer and the overlying charge generating layer to enhance adhesion bonding and to effect ground plane hole injection suppression. Drying of the deposited coating may be effected by any suitable conventional process such as oven drying, infra red radiation drying, air drying and the like. The adhesive layer should be continuous. Satisfactory results are achieved when the adhesive layer has a thickness between about 0.01 micrometer and about 2 micrometers after drying. Preferably, the dried thickness is between about 0.03 micrometer and about 1 micrometer.

The photogenerating layer may comprise single or multiple layers comprising inorganic or organic compositions and the like. One example of a generator layer is described in U.S. Pat. No. 3,121,006, the disclosure of which is totally incorporated herein by reference, wherein finely divided particles of a photoconductive inorganic compound are dispersed in an electrically insulating organic resin binder. Multiphotogenerating layer compositions may be utilized where a photoconductive layer enhances or reduces the properties of the photogenerating layer.

The charge generating layer of the photoreceptor may comprise any suitable photoconductive particle dispersed in a film forming binder. Typical photoconductive particles include, for example, phthalocyanines such as metal free phthalocyanine, copper phthalocyanine, titanyl phthalocyanine, hydroxygallium phthalocyanine, vanadyl phthalocyanine and the like, perylenes such as benzimidazole perylene, trigonal selenium, quinacridones, substituted 2,4-diaminotriazines, polynuclear aromatic quinones, and the like. Especially preferred photoconductive particles include hydroxygallium phthalocyanine, chlorogallium phthalocyanine, benzimidazole perylene and trigonal selenium.

Examples of suitable binders for the photoconductive materials include thermoplastic and thermosetting resins such as polycarbonates, polyesters, including polyethylene terephthalate, polyurethanes, polystyrenes, polybutadienes, polysulfones, polyarylethers, polyarylsulfones, polyethersulfones, polycarbonates, polyethylenes, polypropylenes, polymethylpentenes, polyphenylene sulfides, polyvinyl acetates, polyvinylbutyrals, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchlorides, polyvinyl alcohols, poly-N-vinylpyrrolidinones, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazoles, and the like. These polymers may be block, random or alternating copolymers.

When the photogenerating material is present in a binder material, the photogenerating composition or pigment may be present in the film forming polymer binder compositions in any suitable or desired amounts. For example, from about 10 percent by volume to about 60 percent by volume of the photogenerating pigment may be dispersed in about 40 percent by volume to about 90 percent by volume of the film forming polymer binder composition, and preferably from about 20 percent by volume to about 30 percent by volume of the photogenerating pigment may be dispersed in about 70 percent by volume to about 80 percent by volume of the film forming polymer binder composition. Typically, the photoconductive material is present in the photogenerating layer in an amount of from about 5 to about 80 percent by weight, and preferably from about 25 to about 75 percent by weight, and the binder is present in an amount of from about 20 to about 95 percent by weight, and preferably from about 25 to about 75 percent by weight, although the relative amounts can be outside these ranges.

The photogenerating layer containing photoconductive compositions and the resinous binder material generally ranges in thickness from about 0.05 micron to about 10 microns or more, preferably being from about 0.1 micron to about 5 microns, and more preferably having a thickness of from about 0.3 micron to about 3 microns, although the thickness can be outside these ranges. Generally, it is desirable to provide this layer in a thickness sufficient to absorb about 90 percent or more of the incident radiation which is directed upon it in the imagewise or printing exposure step. The maximum thickness of this layer is dependent primarily upon factors such as mechanical considerations, the specific photogenerating compound selected, the thicknesses of the other layers, and whether a flexible photoconductive imaging member is desired.

The photogenerating layer can be applied to underlying layers by any desired or suitable method. Any suitable technique may be utilized to mix and thereafter apply the photogenerating layer coating mixture. Typical application techniques include spraying, dip coating, roll coating, wire wound rod coating, and the like. Drying of the deposited coating may be effected by any suitable technique, such as oven drying, infra red radiation drying, air drying and the like.

Any suitable solvent may be utilized to dissolve the film forming binder. Typical solvents include, for example, tetrahydrofuran, toluene, methylene chloride, monochlorobenzene and the like. Coating dispersions for charge generating layer may be formed by any suitable technique using, for example, attritors, ball mills, Dynomills, paint shakers, homogenizers, microfluidizers, and the like.

Furthermore, in embodiments, the electrophotographic imaging member may also contain a plurality, e.g., two, charge transport layers comprising a first (bottom) charge transport layer which is in contiguous contact with the photogenerating layer and a second (top) charge transport layer coated over the first charge transport layer.

Optionally, an overcoat layer and/or a protective layer can also be utilized to improve resistance of the photoreceptor to abrasion. In some cases, an anti-curl back coating may be applied to the surface of the substrate opposite to that bearing the photoconductive layer to provide flatness and/or abrasion resistance where a web configuration photoreceptor is fabricated. These overcoating and anti-curl back coating layers are well known in the art, and can comprise thermoplastic organic polymers or inorganic polymers that are electrically insulating or slightly semiconductive. Overcoatings are continuous and typically have a thickness of less than about 10 microns, although the thickness can be outside this range. The thickness of anti-curl backing layers generally is sufficient to balance substantially the total forces of the layer or layers on the opposite side of the substrate layer. An example of an anticurl backing layer is described in U.S. Pat. No. 4,654,284, the disclosure of which is totally incorporated herein by reference. A thickness of from about 70 to about 160 microns is a typical range for flexible photoreceptors, although the thickness can be outside this range. An overcoat can have a thickness of at most 3 microns for insulating matrices and at most 6 microns for semi-conductive matrices. The use of such an overcoat can still further increase the wear life of the photoreceptor, the overcoat having a wear rate of 2 to 4 microns per 100 kilocycles, or wear lives of between 150 and 300 kilocycles.

The photoreceptor of the invention is utilized in an electrophotographic image forming device for use in an electrophotographic imaging process. As explained above, such image formation involves first uniformly electrostatically charging the photoreceptor, then exposing the charged photoreceptor to a pattern of activating electromagnetic radiation such as light, which selectively dissipates the charge in the illuminated areas of the photoreceptor while leaving behind an electrostatic latent image in the non-illuminated areas. This electrostatic latent image may then be developed at one or more developing stations to form a visible image by depositing finely divided electroscopic toner particles, for example from a developer composition, on the surface of the photoreceptor. The resulting visible toner image can be transferred to a suitable receiving member such as paper. The photoreceptor is then typically cleaned at a cleaning station prior to being re-charged for formation of subsequent images.

The photoreceptor of the present invention may be charged using any conventional charging apparatus. Such may include, for example, an AC bias charging roll (BCR) as known in the art. See, for example, U.S. Pat. No. 5,613,173, incorporated herein by reference in its entirety. Charging may also be effected by other well known methods in the art if desired, for example utilizing a corotron, dicorotron, scorotron, pin charging device, and the like.

The invention will now be further described by the following examples and comparative examples, which are intended to further illustrate the invention but not necessarily limit the invention. All parts and percentages are by weight unless otherwise indicated.

EXAMPLE 1

An imaging member was prepared by providing a 0.02 micrometer thick titanium layer coated on a biaxially oriented polyethylene naphthalate substrate (KALEDEX™ 2000) having a thickness of 3.5 mils, and applying thereon, with a gravure applicator, a solution containing 50 grams 3-amino-propyltriethoxysilane, 41.2 grams water, 15 grams acetic acid, 684.8 grams of 200 proof denatured alcohol and 200 grams heptane. This layer was then dried for about 5 minutes at 135° C. in the forced air drier of the coater. The resulting blocking layer had a dry thickness of 500 Angstroms.

An adhesive layer was then prepared by applying a wet coating over the blocking layer, using a gravure applicator, containing 0.2 percent by weight based on the total weight of the solution of copolyester adhesive (ARDEL D100 available from Toyota Hsutsu Inc.) in a 60:30:10 volume ratio mixture of tetrahydrofuran/monochlorobenzene/methylene chloride. The adhesive layer was then dried for about 5 minutes at 135° C. in the forced air dryer of the coater. The resulting adhesive layer had a dry thickness of 200 Angstroms.

A photogenerating layer dispersion is prepared by introducing 0.45 grams of LUPILON® 200® (PCZ 200) available from Mitsubishi Gas Chemical Corp. and 50 ml of tetrahydrofuran into a 4 oz. glass bottle. To this solution are added 2.4 grams of hydroxygallium phthalocyanine (OHGaPc) and 300 grams of ⅛ inch (3.2 millimeter) diameter stainless steel shot. This mixture is then placed on a ball mill for 20 to 24 hours. Subsequently, 2.25 grams of PCZ 200 is dissolved in 46.1 gm of tetrahydrofuran, and added to this OHGaPc slurry. This slurry is then placed on a shaker for 10 minutes. The resulting slurry was, thereafter, applied to the adhesive interface with a Bird applicator to form a charge generation layer having a wet thickness of 0.25 mil. However, a strip about 10 mm wide along one edge of the substrate web bearing the blocking layer and the adhesive layer was deliberately left uncoated by any of the photogenerating layer material to facilitate adequate electrical contact by the ground strip layer that was applied later. The charge generation layer was dried at 135° C. for 5 minutes in a forced air oven to form a dry charge generation layer having a thickness of 0.4 micrometer.

EXAMPLE 2 (COMPARATIVE)

A photogenerator layer of Example 1 was coated with a transport layer (HTM) containing 48 weight percent (based on the total solids) of the hole transport compound, N,N'-diphenyl-N,N'-bis(3-methyl-phenyl)-(1,1'-biphenyl)-4,4'-diamine.

In a four ounce brown bottle, 9.4 grams of LUPILON® 500® (PCZ 500 available from Mitsubishi Gas Chemical Corp.) was dissolved into 106 grams of methylene chloride. It was then stirred with a magnetic bar. After the polymer was completely dissolved, 4.512 grams of N,N'-diphenyl-N,N'-bis(3-methylphenyl)-1,1'-biphenyl-4,4'-diamine was added. The mixture was stirred overnight to assure a complete solution. The solution was applied onto the photogenerator layer made in example 1 using a 4 mil Bird bar to form a coating. The coated device was then heated in a forced hot air oven where the air temperature was elevated from about 40° C. to about 120° C. over a 30 minute period to form a charge transport layer having a dry thickness of 29 micrometers.

EXAMPLE 3

A photogenerator layer of Example 1 was coated with a transport layer (STML) containing 48 weight percent (based on the total solids) of the hole transport compounds consisting of the combination of N,N'-diphenyl-N,N'-bis(3-methyl-phenyl)-(1,1'-biphenyl)-4,4'-diamine (TPD) and N,N-di-(3,4-dimethylphenyl)-4-biphenylamine (DBA), and 0.8% UCARMAG 527® available from Union Carbide.

In a four ounce brown bottle, 10.95 grams LUPILON® 500 (PCZ 500 available from Mitsubishi Gas Chemical Corp.) was dissolved into 123.5 grams of methylene chloride and was stirred with a magnetic bar. After the polymer was completely dissolved, 1.66 grams N,N'-diphenyl-N,N'-bis(3-methylphenyl)-1,1'-biphenyl-4,4'-diamine, 6.66 grams of N,N-di-(3,4-dimethylphenyl)-4-biphenylamine, and 0.18 grams UCARMAG 527® were added. The mixture was stirred overnight to assure a complete solution. The solution was applied onto the photogenerator layer of Example 1 using a 4 mil Bird bar to form a coating. The coated device was then heated in a forced hot air oven where the air temperature was elevated from about 40° C. to about 120° C. over a 30 minute period to form a charge transport layer having a dry thickness of 29 micrometers.

EXAMPLE 4

A photogenerator layer of Example 1 was coated with a transport layer (STML) containing 48 weight percent (based on the total solids) of the hole transport compounds consisting of the combination of N,N'-diphenyl-N,N'-bis(3-methyl-phenyl)-(1,1'-biphenyl)-4,4'-diamine (TPD) and N,N-di-(3,4-dimethylphenyl)-4-biphenylamine (DBA), and 0.4% UCARMAG 527® available from Union Carbide. In a four ounce brown bottle, 11.04 grams LUPILON® 500 (PCZ 500 available from Mitsubishi Gas Chemical Corp.) was dissolved into 123.5 grams of methylene chloride and was stirred with a magnetic bar. After the polymer was completely dissolved, 1.66 grams N,N' -diphenyl-N,N' -bis (3-methylphenyl)-1,1'-biphenyl-4,4'-diamine, 6.66 grams of N,N-di-(3,4-dimethylphenyl)-4-biphenylamine, and 0.088 grams UCARMAG 527® were added. The mixture was stirred overnight to assure a complete solution. The solution was applied onto the photogenerator layer of Example 1 using a 4 mil Bird bar to form a coating. The coated device was then heated in a forced hot air oven where the air temperature was elevated from about 40° C. to about 120° C. over a 30 minute period to form a charge transport layer having a dry thickness of 29 micrometers.

EXAMPLE 5

A photogenerator layer of Example 1 was coated with a transport layer (STML) containing 48 weight percent (based on the total solids) of the hole transport compounds consisting of the combination of N,N'-diphenyl-N,N'-bis(3-methyl-phenyl)-(1,1'-biphenyl)-4,4'-diamine (TPD) and N,N-di-(3,4-dimethylphenyl)-4-biphenylamine (DBA), CYANOX 2176 and UCARMAG 527® available from Union Carbide.

In a four ounce brown bottle, 9.84 grams LUPILON® 500 (PCZ 500 available from Mitsubishi Gas Chemical Corp.) was dissolved into 123.5 grams of methylene chloride and was stirred with a magnetic bar. After the polymer was completely dissolved, 2.75 grams N,N'-diphenyl-N,N'-bis (3-methylphenyl)-1,1'-biphenyl-4,4'-diamine, 5.58 grams of N,N-di-(3,4-dimethylphenyl)-4-biphenylamine, 1.2 grams CYANOX 2176 and 0.088 grams UCARMAG 527® were added. The mixture was stirred overnight to assure a complete solution. The solution was applied onto the photogenerator layer of Example 1 using a 4 mil Bird bar to form a coating. The coated device was then heated in a forced hot air oven where the air temperature was elevated from about 40° C. to about 120° C. over a 30 minute period to form a charge transport layer having a dry thickness of 29 micrometers.

EXAMPLE 6

A photogenerator layer of Example 1 was coated with a transport layer (STML) containing 48 weight percent (based on the total solids) of the hole transport compounds consisting of the combination of N,N'-diphenyl-N,N'-bis(3-methyl-phenyl)-(1,1'-biphenyl)-4,4'-diamine (TPD) and N,N-di-(3,4-dimethylphenyl)-4-biphenylamine (DBA), bisphenol Z polycarbonate, CYANOX 2176 and UCARMAG 527® available from Union Carbide.

In a four ounce brown bottle, 9.75 grams LUPILON® 500 (PCZ 500 available from Mitsubishi Gas Chemical Corp.) was dissolved into 123.5 grams of methylene chloride and was stirred with a magnetic bar. After the polymer was completely dissolved, 1.66 grams N,N'-diphenyl-N,N'-bis (3-methylphenyl)-1,1'-biphenyl-4,4'-diamine, 6.66 grams of N,N-di-(3,4-dimethylphenyl)-4-biphenylamine, 1.2 grams CYANOX 2176 and 1.8 grams UCARMAG 527® were added. The mixture was stirred overnight to assure a complete solution. The solution was applied onto the photogenerator layer of Example 1 using a 4 mil Bird bar to form a coating. The coated device was then heated in a forced hot air oven where the air temperature was elevated from about 40° C. to about 120° C. over a 30 minute period to form a charge transport layer having a dry thickness of 29 micrometers.

TABLE 1

| Example | CYANOX, wt % | TPD, wt % | DBA, wt % | UCARMAG, wt % |
|---|---|---|---|---|
| 2 | 0 | 48.0 | 0 | 0 |
| 3 | 0 | 9.6 | 38.4 | 0.8 |
| 4 | 0 | 9.6 | 38.4 | 0.4 |
| 5 | 2.5 | 15.84 | 32.16 | 0.4 |
| 6 | 2.5 | 15.84 | 32.16 | 0.8 |

EXAMPLE 7

The flexible photoreceptor sheets prepared as described in Example 2 were tested for their xerographic sensitivity and cyclic stability in a scanner. In the scanner, each photoreceptor sheet to be evaluated was mounted on a cylindrical aluminum drum substrate which was rotated on a shaft. The devices were charged by a corotron mounted along the periphery of the drum. The surface potential was measured as a function of time by capacitively coupled voltage probes placed at different locations around the shaft. The probes were calibrated by applying known potentials to the drum substrate. Each photoreceptor sheet on the drum was exposed to a light source located at a position near the drum downstream from the corotron. As the drum was rotated, the initial (pre-exposure) charging potential was measured by a voltage probe. Further rotation lead to an exposure station, where the photoreceptor device was exposed to monochromatic radiation of a known intensity. The devices were erased by a light source located at a position upstream of charging. The measurements illustrated in Table 2 included the charging of each photoconductor device in a constant current or voltage mode. The devices were charged to a negative polarity corona. The surface potential after exposure was measured by a second voltage probe. The devices were finally exposed to an erase lamp of appropriate intensity and any residual potential was measured by a third voltage probe. The process was repeated with the magnitude of the exposure automatically changed the next cycle. The photodischarge characteristics were obtained by plotting entials at a voltage probe as a function of light exposure.

TABLE 2

| Example | Residual Voltage at 0k cycle | Residual Voltage at 10k cycle | Sensitivity at 0k cycles | Sensitivity at 10k cycles | Background Voltage at 6 ergs, 0k cycles | Background Voltage at 6 ergs 10k cycles | Stability |
|---|---|---|---|---|---|---|---|
| 2 | 41 | 70 | 363 | 335 | 70 | 109 | −40 |
| 3 | 41 | 12 | 381 | 356 | 63 | 42 | 21 |
| 4 | 24 | 8 | 388 | 359 | 44 | 36 | 8 |
| 5 | 24 | 29 | 364 | 337 | 53 | 59 | −7 |
| 6 | 46 | 24 | 371 | 347 | 64 | 53 | 12 |

EXAMPLE 8

LCM deletion caused by corona: Hand-coated samples of the formulations described in Examples 2 to 6 were cut into small sheets (1.5 inches×11 inches) and wrapped around a 84 mm photoreceptor drum. This drum with the sample belt wrapping around it was then exposed to corona effluents generated from a charging device. After being exposed for 30 minutes, using a DC 12 Limoges printer, the drum was printed with a target containing various types of bit lines for LCM deletion. The target print has 5 different bit lines ranging from 1 bit to 5 bit. The FIGURE shows the effect of corona effluents on LCM for all the formulations of the invention and the comparative formulation. The sample with the least number of visible lines was badly affected by corona effluents and completely deleted if there were no visible lines. The comparative formulation (Example 2) was badly deleted after 30 minutes exposure to corona, whereas all of the formulations of the invention are not substantially affected by LCM deletion. With 0 being without any deletion and 6 being the worst sample, the comparative formulation has a grade of 6.

EXAMPLE 9

Mechanical cracks caused by solvent vapor: Hand-coated samples of Examples 2 to 6 were cut into small sheets as above and wrapped around two 0.5 inch diameter rods. One rod is exposed to a solvent vapor mixture of 3.73% i-propanol alcohol, 2.76% TEA (triethanol amine), and 93.5% water in a sealed container for 6 days. Cracks on the photoreceptor belts can be visualized by human eyes under an appropriate lighting system. With 0 being without any crack and 6 being the worst cracked sample, the comparative formulation has a grade of 2, samples from Examples 3 and 4 have a grade of 1 and samples from Examples 5 and 6 have a grade of 5.

EXAMPLE 10

Mechanical cracks caused by corona effluent: The second rod was exposed to corona effluents inside a large glass tub for 12 hours. The charging system was setup at 400 mA and 7000 V. Under the same grading system as above, the comparative formulation shows a cracking grade of 4 whereas all formulations of the invention are found without any crack and graded with 0.

EXAMPLE 11

Machine cracks caused by breakdown of cechanical strength of the charge transport layer: Hand-coated samples of Examples 2 to 6 were cut into small sheets as above and are flexed in a tri-roller flexing system. Each belt is under a 1.1 lb/inch tension and each roller is 0.5 inches in diameter. Flexing life of a belt is defined as the number of cycles that the first delaminated crack is visualized. The printable cracks occur at the charge transport layer and end at the interface with the substrate. While the comparative formulation has a 16,000 cycle life, formulations of Examples 3 and 4 have a life ranging from 16,000 to 26,000 cycles and those of Examples 5 and 6 have a life ranging from 8000 to 10,000 cycles.

TABLE 3

| Example | LCM Rating | Solvent Crack Rating | Corona Crack Rating | Flexing Life, kcycles |
|---|---|---|---|---|
| 2 | 6 | 2 | 4 | 16 |
| 3 | 3 | 1 | 0 | 26 |
| 4 | 2 | 1 | 0 | 16 |
| 5 | 0 | 5 | 0 | 8 |
| 6 | 1 | 5 | 0 | 10 |

Note:
Rating = 0 is the best, and 6 is the worst.

Note: Rating=0 is the best, and 6 is the worst.

While the invention has been described in conjunction with exemplary embodiments, these embodiments should be viewed as illustrative, not limiting. Various modifications, substitutes, or the like are possible within the spirit and scope of the invention.

The invention claimed is:

1. A charge transport layer composition for a photoreceptor, comprising at least a binder and a charge transport material comprised of N,N-di-(3,4-dimethylphenyl)-4-biphenylamine and about 10% to about 50% by weight of a total of the charge transport material of N,N'-diphenyl-N,N'-bis(3-methylphenyl)-(1,1'-biphenyl)-4,4'-diamine, wherein the total of the charge transport material in the composition comprises 48% or less of the total solids of the composition, and wherein the charge transport layer material further comprises a vinyl chloride copolymer of at least vinyl chloride, vinyl acetate, hydroxy alkyl acrylate and maleic acid.

2. A charge transport layer composition according to claim 1, wherein the charge transport layer material further comprises a hindered phenol antioxidant.

3. A charge transport layer composition according to claim 2, wherein the hindered phenol antioxidant has the structure

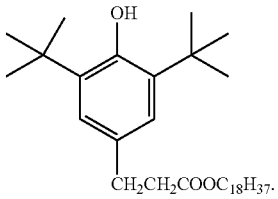

4. A charge transport layer composition according to claim 1, wherein the hydroxy alkyl acrylate of the vinyl chloride copolymer is selected from the group consisting of hydroxy ethyl acrylate and hydroxy propyl acrylate.

5. A charge transport layer composition according to claim 1, wherein the charge transport layer composition includes N,N-di-(3,4-dimethylphenyl)-4-biphenylamine in an amount of from about 90% to about 50% by weight of the total of the charge transport material in the composition.

6. A charge transport layer composition according to claim 1, wherein the total weight of the charge transport material in the charge transport layer composition is from about 30% to about 46% by weight of total solids of the charge transport layer composition.

7. A charge transport layer composition according to claim 1, wherein the total weight of the charge transport material in the charge transport layer composition is from about 40% to about 44% by weight of total solids of the charge transport layer composition.

8. A charge transport layer composition according to claim 1, wherein the binder is a polycarbonate binder.

9. A charge transport layer composition according to claim 8, wherein the polycarbonate binder is a biphenyl A polycarbonate or a bisphenol Z polycarbonate.

10. A charge transport layer composition according to claim 1, wherein the charge transport layer composition further comprises methylene chloride solvent.

11. A charge transport layer composition according to claim 1, wherein the vinyl chloride copolymer comprises about 5% or less by weight, solids basis, of the charge transport layer composition.

12. An image forming device comprising at least a photoreceptor and a charging device that charges the photoreceptor, wherein the photoreceptor comprises an optional anti-curl layer, a substrate, an optional hole blocking layer, an optional adhesive layer, a charge generating layer, a charge transport layer comprising at least a binder and a charge transport material comprised of 100 to about 40% by weight of a total of the charge transport layer N,N-di-(3,4-dimethylphenyl)-4-biphenylamine and about 10% to about 50% by weight N,N'-diphenyl-N,N'-bis(3-methylphenyl)-(1,1'-biphenyl)-4,4'-diamine, wherein the total of the charge transport material in the layer comprises 48% or less of the total solids of the composition, and wherein the charge transport layer material further comprises a vinyl chloride copolymer of at least vinyl chloride, vinyl acetate, hydroxy alkyl acrylate and maleic acid, and optionally one or more overcoat or protective layers.

13. An image forming device according to claim 12, wherein the charge transport layer further comprises a hindered phenol antioxidant.

14. An image forming device according to claim 12, wherein the charge transport layer includes N,N-di-(3,4-dimethylphenyl)-4-biphenylamine in an amount of from about 90% to about 50% by weight of the total of the charge transport material in the charge transport layer.

15. An image forming device according to claim 12, wherein the total weight of the charge transport material in the charge transport layer is from about 30% to about 46% by weight of total solids of the charge transport layer.

16. An image forming device according to claim 12, wherein the total weight of the charge transport material in the charge transport layer is from about 40% to about 44% by weight of total solids of the charge transport layer.

17. An image forming device according to claim 12, wherein the vinyl chloride copolymer comprises about 5% or less by weight, solids basis, of the charge transport layer.

* * * * *